US007395644B2

(12) United States Patent
Rivenbark et al.

(10) Patent No.: US 7,395,644 B2
(45) Date of Patent: Jul. 8, 2008

(54) INSERTING APPARATUS AND METHOD WITH CONTROLLED, MASTER CYCLE SPEED-DEPENDENT ACTUATOR OPERATIONS

(75) Inventors: James R. Rivenbark, Raleigh, NC (US); Keith A. Harshman, Apex, NC (US); Frank J. Shinn, Fuquay-Varina, NC (US); Bradford D. Henry, Cary, NC (US); Steve W. McCay, deceased, late of Raleigh NC (US); by Kathleen E McCay, legal representative, Raleigh, NC (US)

(73) Assignee: Bowe Bell + Howell Company, Durham, NC (US)

( * ) Notice: Subject to any disclaimer, the term of this patent is extended or adjusted under 35 U.S.C. 154(b) by 779 days.

(21) Appl. No.: 10/626,595

(22) Filed: Jul. 25, 2003

(65) Prior Publication Data

US 2005/0246139 A1 Nov. 3, 2005

Related U.S. Application Data

(60) Division of application No. 09/843,231, filed on Apr. 26, 2001, now Pat. No. 6,718,740, which is a continuation-in-part of application No. 09/159,437, filed on Sep. 24, 1998, now abandoned.

(51) Int. Cl.
*B65B 11/48* (2006.01)

(52) U.S. Cl. ..... 53/460; 53/569; 53/381.6

(58) Field of Classification Search ..... 53/569, 53/381.5, 381.6, 460; 198/461.2, 461.3; 271/2

See application file for complete search history.

(56) References Cited

U.S. PATENT DOCUMENTS

| | | | |
|---|---|---|---|
| 3,423,900 | A | 1/1969 | Orsinger |
| 4,722,168 | A | 2/1988 | Heaney |
| 5,125,214 | A | 6/1992 | Orsinger et al. |
| 5,177,930 | A | 1/1993 | Harston et al. |
| 5,251,425 | A | 10/1993 | Kern |
| 5,414,977 | A | 5/1995 | Cohen |
| 5,415,068 | A | 5/1995 | Marzullo |
| 5,457,941 | A | 10/1995 | Long et al. |
| 5,485,712 | A | 1/1996 | Cherney et al. |
| 5,524,421 | A | 6/1996 | Nauheimer et al. |
| 5,538,232 | A | 7/1996 | Long |
| 5,555,701 | A | 9/1996 | Fehringer et al. |

(Continued)

FOREIGN PATENT DOCUMENTS

| | | |
|---|---|---|
| JP | 7-49289 | 5/1995 |

(Continued)

*Primary Examiner*—Sameh H. Tawfik
(74) *Attorney, Agent, or Firm*—McDermott Will & Emery LLP

(57) ABSTRACT

In an inserting apparatus and method such as the continuous motion type, a motion controller electrically communicates with an encoder, a first motor driving an insert conveyor assembly, a second motor driving an envelope conveyor assembly, and an actuator operatively interfaced with a peripheral device. The motion controller controls insert conveyor assembly speed, envelope conveyor assembly speed, and the rotational position at which the actuator should be activated, based on the encoder signal. Once during every master cycle, the motion controller calculates the actuator activation position, and causes the first actuator to be activated at the calculated first actuator activation position.

16 Claims, 11 Drawing Sheets

U.S. PATENT DOCUMENTS 5,628,249 A 5/1997 Codery et al.
5,706,627 A 1/1998 Kirka et al.
5,727,954 A 3/1998 Kato et al.
5,729,954 A 3/1998 Lines et al.
5,809,749 A 9/1998 Ruggiero et al.
5,819,666 A 10/1998 Ishikawa et al.
5,823,521 A 10/1998 Emigh et al.
5,852,918 A 12/1998 Hidding et al.
5,899,050 A 5/1999 Bergwerf
5,924,265 A 7/1999 Auerbach
5,941,516 A 8/1999 Emigh et al.
5,949,687 A 9/1999 Emigh et al.
6,230,471 B1 5/2001 Robertson et al.

FOREIGN PATENT DOCUMENTS

JP 7-77889 8/1995

INSERTING APPARATUS AND METHOD WITH CONTROLLED, MASTER CYCLE SPEED-DEPENDENT ACTUATOR OPERATIONS

This application is a divisional of application Ser. No. 09/843,231 filed Apr. 26, 2001 now U.S. Pat. No. 6,718,740 which is a continuation-in-part of application Ser. No. 09/159,437 filed Sep. 24, 1998 now abandoned.

TECHNICAL FIELD

The present invention is generally directed to an inserting apparatus and method, such as the type of apparatus and method useful in performing mail inserting operations in which an insert is inserted into an envelope for subsequent processing. More particularly, the present invention is directed to an inserting apparatus and method capable of adaptively controlling one or more actuated components in response to a change in the cycle speed of the apparatus.

BACKGROUND ART

Mail insertion machines implementing continuous motion, or at least substantially continuous motion, have been developed in the past. A basic function of such machines is to establish a flow of inserts, such as documents or other sheet-type products, establish a flow of envelopes, and combine both flows into a single, common feed path. Once a given insert and a given envelope enter the common feed path, the insert must be inserted into the opened envelope at a common insertion point, after which point the stuffed envelope is transported downstream along a single output path for subsequent processing. In the continuous motion-type insertion machine, an effort is made to increase throughput by reducing the number of times the feed path must be stopped and/or reducing the duration of the stoppage. This has been accomplished by transporting the inserts along the feed path at a higher speed than the envelopes, or by at least accelerating the inserts in relation to the envelopes, so that a given insert "overtakes" or catches up to its corresponding, aligned envelope and is completely inserted into the envelope with minimal stoppage of the flow of either the insert or the envelope along the feed path.

As will be appreciated by persons skilled in the art, the successful operation of the above-described mail insertion machine depends upon adequate synchronization of the various moving components involved in carrying out the insertion process. It is often desirable to change the overall speed of the machine, such as when differently-sized inserts and/or envelopes are to be processed, in which case steps must be taken to ensure all moving components are still synchronized at the different machine speed. For example, in U.S. Pat. No. 3,423,900 to Orsinger, a continuous motion inserting machine is disclosed in which all moving components, such as the envelope feeding and insert feeding mechanisms, are entirely mechanically linked together. It can be appreciated that any change in the operating speed of such a machine would necessitate laborious mechanical adjustments of several components in order to preserve synchronization.

Even with the modern development of servo motors and motion controllers, satisfactory methods have not heretofore been developed for interfacing such modern control components with mail inserting machines for the purpose of maintaining synchronization in response to varied machine speeds, particularly in the context of continuous motion-type inserting machines. Indeed, the use of modern machine components often exacerbates the problem of synchronization. This has been particularly observed in the case of modern, variable-speed, cyclical mail inserting machines. During the operation of such machines, the duration of time between certain events vary according to overall machine speed. These machines, however, contain both servo motor-driven components or assemblies and actuator-driven components. The respective operating speeds of the motor-driven components or assemblies can be easily controlled and varied by a motion controller. At the same time, however, the respective activation speeds of the actuator-driven components (i.e., the duration of time required for the component to move from its inactive or OFF state to its active or ON state) are inherently fixed and thus cannot be forced to vary. It can therefore be appreciated that the use of variable-speed components together with fixed-speed components renders synchronization difficult.

As an example, a variable-speed cyclical machine contains one or more rotating assemblies or components whose respective operating speeds somehow depend on the master speed of the machine (such as through actual linkage to the main drive shaft of the machine, or simply due to the requisite timing relation among the various moving components of the machine). If, for example, the machine is running at a machine speed of 1 cycle per second, the machine takes 250 milliseconds to move through 90 degrees of its machine cycle. If the speed of the machine is increased to 5 cycles per second, the machine now takes only 50 milliseconds to move through the same 90 degrees of the machine cycle at this new machine speed. As part of its operation, the machine can further contain at least one component driven by a solenoid. As a general matter, solenoids take a constant duration of time to become active (e.g., the time required for the plunger of the solenoid to fully extend outwardly and actually cause the required actuation event), and this activation time is completely independent of the machine speed. In the present example, the solenoid takes 50 milliseconds to become active. The successful operation of this machine dictates that the solenoid be fully active at a given point in time during the machine cycle (e.g., 90 degrees). In addition, the operation requires that the solenoid be inactive until another given point during the cycle (e.g., 85 degrees). Accordingly, there exists no common point during any machine cycle at which the solenoid can be turned ON for all speeds over which the machine is intended to operate.

Continuing with the present example, at the machine rate of one cycle per second, the machine travels 18 degrees (90 degrees divided by 5) in 50 milliseconds (250 milliseconds divided by 5). At this rate, the solenoid must be activated, or fired, at 72 degrees (90 degrees minus 18 degrees) in order for the solenoid to be fully activated at 90 degrees. This is because, upon the initial energizing of this particular solenoid, it always takes 50 milliseconds for the solenoid to become completely active. In the present example, at 1 cycle per second, 50 milliseconds corresponds to 18 degrees of rotation through the machine cycle. As discussed above, at the machine rate of 5 cycles per second, the machine travels 90 degrees in 50 milliseconds. Hence, at this increased machine cycle speed, the solenoid must fire at 0 degrees in order to be fully activated at 90 degrees (because at 5 cycles per second, 50 milliseconds corresponds to 90 degrees, instead of 18 degrees in the case of a cycle speed of 1 cycle per second).

It can thus be seen that if the machine has been operating at 5 cycles per second and the solenoid is correctly set to fire at 0 degrees at that machine speed, the solenoid will fire at the wrong time if the machine speed is changed. In the specific example, if the machine speed is decreased to 1 cycle per second and the solenoid fires at 0 degrees, the solenoid will become fully active at 18 degrees, which is much too early during the machine cycle if the machine is running at 1 cycle per second. One the other hand, if the solenoid is set to fire correctly (at 72 degrees) while the machine speed is 1 cycle per second, and the machine is actually running at 5 cycles per second, then the solenoid will not be fired until the machine cycle reaches 72 degrees and thus will not be active until 162 degrees (72 degrees plus 90 degrees, where 90 degrees corresponds to the fixed activation time of the solenoid, 50 milliseconds, at the machine speed of 5 cycles per second), which is much too late.

In either scenario, the solenoid will fire, and thus eventually become fully active, at the wrong point in time during the operating cycle of the machine. In the context of a continuous motion inserting machine, as well as in other types of machines requiring coordination and synchronization of different moving components, the improper activation time of the solenoid could result in an insert or an envelope failing to be presented at the proper time into the feed path, an envelope failing to open, an insert failing to be completely inserted into an envelope prior to ejection to downstream processes, and so on.

One approach to maintaining proper control and synchronization in a variable-speed inserter machine is disclosed in the following series of related disclosures: U.S. Pat. Nos. 5,823,521; 5,941,516; 5,949,687; 5,954,323; and 5,975,514; all of which issued to Emigh et al, and are owned by Bell & Howell Mail and Messaging Technologies Co. In the main embodiment disclosed in these patens, a Phillipsburg-type mail inserter machine has twelve stations or subassemblies, all of which operate (i.e., are activated and deactivated) in timed relation over the 360-degree timing cycle of the inserter machine. The respective operations of these stations is put under computer-driven, adaptive control, in order to compensate for the electromechanical time lags exhibited by certain components such as pneumatic cylinders that require extension and retraction. As a result, the ON-OFF control signal used to initiate and terminate the respective electromechanical functions of the actuator-type components can be adjusted in response to a change in machine speed, thereby maintaining correct timing of the various components.

In the Emigh et al. patents, the adaptive control is implemented by programming "look-up" speed tables into the control software executed by the computer. These speed tables include the correct start angles (i.e., the timing for an ON control signal) and stop angles (i.e., the timing for an OFF control signal) for each station requiring such control. A "low" speed table, derived empirically, is provided for the machine operating within the range of 0-2000 cycles per hour. Additionally, the respective time lags (or activation times) for the various actuator-type components are empirically measured, and the resulting value stored in an "operational delay" look-up table. The values from the operational delay tables are used together with the cycle speed of the machine to calculate adaptive adjustment factors, which in turn are used in further calculations to determine new start and stop angles for a different cycle speed. These new values are entered into a new speed table. This process is carried out until five successive speed tables are generated, each corresponding to a cycle speed range of 2,000 cycles per hour in width, such that the five speed tables cover the operation of the machine over a total range of 0-10,000 cycles per hour. The mail inserter machine is ready for operation only after all five predetermined speed tables have been stored in memory.

During operation of the mail inserter machine disclosed in the Emigh et al. patents, the computer samples the output of a tachometer such as an absolute optical encoder interfaced with the main drive shaft of the machine. This sampling is rigidly performed at constant intervals as dictated by a clock speed, regardless of what the machine is actually doing. In the specific embodiment disclosed, the sampling is taken without exception every 100 milliseconds. Based on the cycle speed measured by the encoder, the computer selects the appropriate speed table and uses the values from the selected speed table to determine the proper control signals to be issued to the actuator-type components. As an alternative, the computer can use the low speed table and the operational delay table to update a new speed table every 100 milliseconds. It is disclosed, however, that this latter method has the disadvantage of possibly slowing down the computer due to the CPU having to make repetitive calculations every 100 milliseconds.

It would be therefore be advantageous to provide a method and apparatus for more precisely controlling and adjusting actuators in response to variable machine speeds on a substantially continuous basis, particularly in the operating environment of continuous motion inserting machines, in order to more easily and precisely maintain synchronization after a speed adjustment occurs, and further to ensure more consistent performance during ramp-up and shut-down portions of the machine cycle.

DISCLOSURE OF THE INVENTION

The present invention provides a method for controlling a machine that operates over a master cycle at variable cycle speeds, and that includes one or more assemblies which perform rotational movements in synchrony and in combination with one or more other actuated peripheral devices. The peripheral devices are activated by actuators such as solenoids known to exhibit generally constant time lags. Conventionally, such machines are not capable of operating at different cycle speeds, since such a change has in the past thrown the rotational assemblies out of synchronization with the peripheral devices. The method according to the present invention, however, has the advantageous feature of being able to make on-the-fly adjustments to solenoid timing in response to changing cycle speed, and thus efficiently maintain synchronization. This method is implemented by a motion controller or other suitable device capable of electronic processing of an instruction set for performing position-based velocity compensation. The method has been successfully demonstrated in the environment of a continuous motion inserting apparatus, such as the type employed in mail processing jobs, although it will be understood that the present invention will have application outside the immediate scope of the continuous motion inserting apparatus. The present invention can be implemented in mail inserting machines other than the continuous-motion type, as well as any machine requiring synchronization among rotational and actuated components.

According to one embodiment of the present invention, an inserting apparatus operable over a range of master cycle speeds comprises a master drive assembly, an encoder, an insert conveyor assembly, an envelope conveyor assembly, a first actuator, and a motion controller. The master drive assembly is operative over a master cycle and at variable master cycle speeds. The encoder is operatively coupled to the master drive assembly, and is adapted to produce an encoder signal indicative of a current master cycle speed at which the master drive assembly is operating. The insert conveyor assembly is driven by a first motor at a variable insert conveyor speed. The envelope conveyor assembly is driven by a second motor at a variable envelope conveyor speed. During any master cycle, the insert conveyor assembly speed can be greater than the envelope conveyor assembly speed in order to implement continuous-motion inserting operations. The first actuator has a substantially constant activation time lag, and is disposed in actuating communication with a first peripheral device. The motion controller controls the insert conveyor assembly speed, the envelope conveyor assembly speed and an activation position of the first actuator based on the encoder signal. Accordingly, the motion controller electrically communicates with the encoder, the first motor, the second motor and the first actuator. Once during every master cycle, the motion controller calculates the first actuator activation position, and causes the first actuator to be activated at the calculated first actuator activation position.

According to another embodiment of the present invention, the inserting apparatus includes a computer program product comprising computer-executable instructions embodied in a computer-readable medium. The computer program product communicates with the motion controller and is adapted to, once during every master cycle, calculate the first actuator activation position and cause the first actuator to be activated at the calculated first actuator activation position.

According to yet another embodiment of the present invention, a method is provided for controlling an inserting apparatus over a range of master cycle speeds. The method encompasses monitoring a master cycle speed at which an inserting apparatus operates over a plurality of master cycles, and determining when a new master cycle has begun. Once during every master cycle of operation of the inserting apparatus, a first calculation is performed. The first calculation determines a first cyclical position of the new master cycle at which an actuated device should begin to be activated. The calculation is based on the master cycle speed measured for the new master cycle, a predetermined time duration required for the actuated device to become fully active, and a predetermined cyclical position of the new master cycle at which the actuated device should be fully active. The actuated device is caused to begin to be activated when the new master cycle reaches or exceeds the calculated first cyclical position.

According to still another embodiment of the present invention, the method also encompasses, once during every master cycle of operation of the inserting apparatus, performing a second calculation to determine a second cyclical position of the new master cycle at which an actuated device should begin to be deactivated. This calculation is based on the master cycle speed measured for the new master cycle, a predetermined time duration required for the actuated device to become inactive, and a predetermined cyclical position of the new master cycle at which the actuated device should be fully inactive. The actuated device is caused to become inactive when the new master cycle reaches or exceeds the calculated second cyclical position.

According to a further embodiment of the present invention, the method is implemented by a computer program product comprising computer-executable instructions embodied in a computer-readable medium.

According to a still further embodiment of the present invention, a method is provided for continuously inserting inserts into corresponding envelopes in a controlled manner, and over a range of master cycle speeds at which an inserting apparatus operates. The method encompasses monitoring a master cycle speed at which an inserting apparatus operates over a plurality of master cycles, and determining when a new master cycle has begun. Once during every master cycle of operation of the inserting apparatus, a first calculation is performed. The first calculation determines a first cyclical position of the new master cycle at which an actuated device should begin to be activated. The calculation is based on the master cycle speed measured for the new master cycle, a predetermined time duration required for the actuated device to become fully active, and a predetermined cyclical position of the new master cycle at which the actuated device should be fully active. The actuated device is caused to begin to be activated when the new master cycle reaches or exceeds the calculated first cyclical position. Activation of the actuated device assists in an inserting process performed by the inserting apparatus, such as by opening an envelope prior to insertion, registering an envelope, or transporting the stuffed envelope away at the correct point in time during the machine cycle.

The method further encompasses feeding an insert along a feed path at an insert feed rate in timed relation with the activation of the actuated device, and likewise feeding an envelope along the feed path at an envelope feed rate in timed relation with the activation of the actuated device. The insert feed rate is greater than the envelope feed rate, so that the insert is caused to be inserted into the envelope, again in timed relation with the activation of the actuated device.

It is therefore an object of the present invention to provide an improved continuous motion inserting machine and an improved inserting method, wherein tight control and synchronization of the various moving components can be maintained over a wide range of machine speeds.

It is another object of the present invention to provide an inserting machine and related method that include a motion controller or other electronic processing device, which motion controller is capable of calculating in real time the correct cyclic positioning of certain actuated components during operation of the inserting machine, so that a change in machine speed will not require a reconfiguration of one of more machine components.

It is yet another object of the present invention to provide an inserting machine and related method that update the activation times of certain components every master rotation or master cycle of the inserting machine, such that the frequency of the updating process varies directly with the speed of the master cycle.

Some of the objects of the invention having been stated hereinabove, other objects will become evident as the description proceeds when taken in connection with the accompanying drawings as best described hereinbelow.

DETAILED DESCRIPTION OF THE INVENTION

Figure 1:
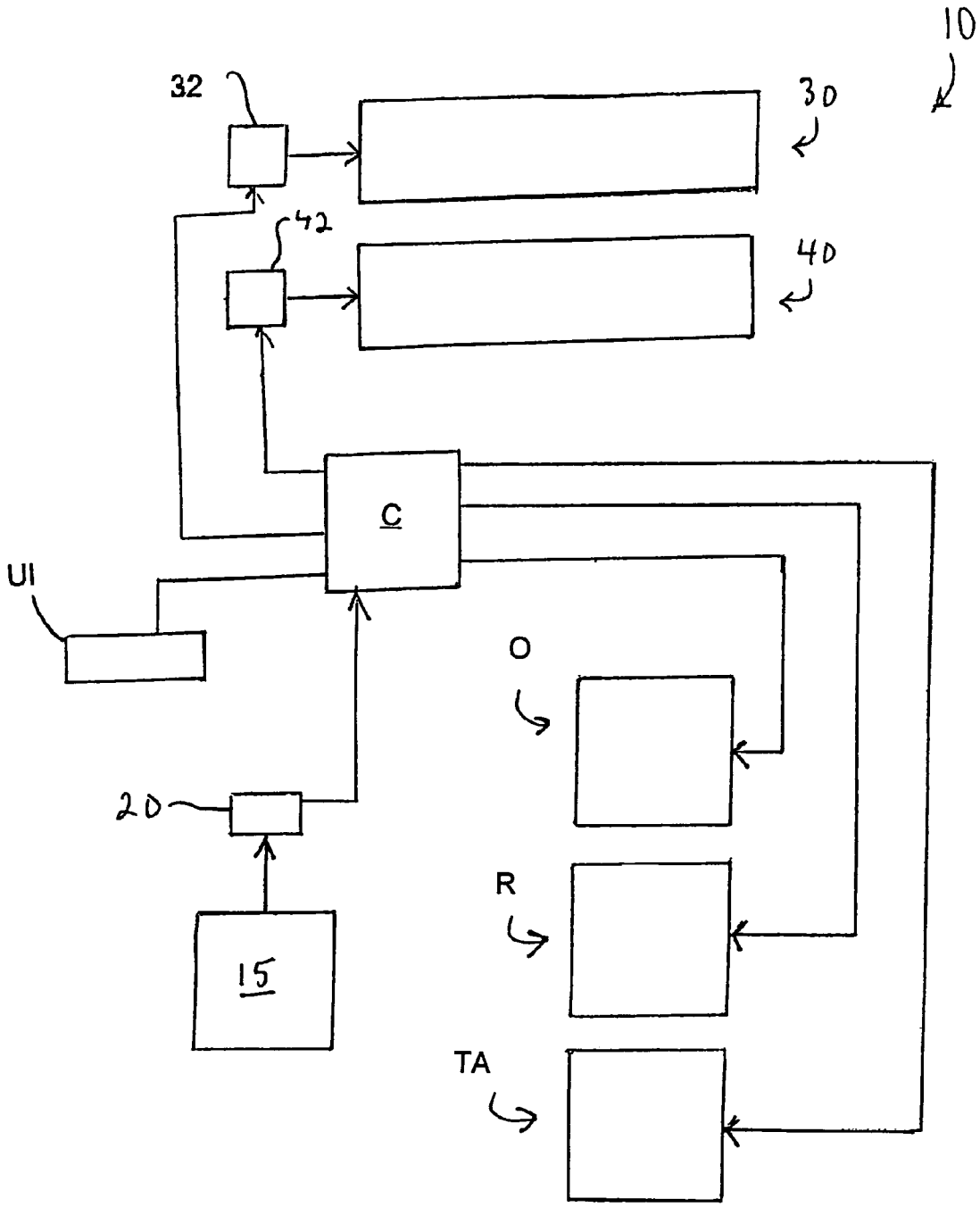
FIG. 1 is a schematic diagram of an inserting apparatus according to the present invention.

Referring now to FIG. 1, an inserting apparatus or system generally designated 10, is schematically illustrated. Inserting apparatus 10 includes a master drive assembly 15 that typically drives a primary function such as the transport of inserts downstream to one or more assemblies associated with insertion apparatus 10. Master drive assembly 15 includes a rotating component (not specifically shown), such as a motor driven drive shaft, which might be mechanically linked to other rotating components as understood by persons skilled in the art. An encoder 20 or similar device interfaces with the rotating component of master drive assembly 15. Encoder 20 the rate at which master drive assembly 15 is physically rotating (i.e, the master cycle speed) in encoder pulses per second, and converts this measurement into an electrical output signal. The encoder signal is read and interpreted by a motion controller C, which includes an I/O interface, signal conditioning and amplification elements, and associated circuitry as understood by persons skilled in the art.

Inserting apparatus 10 further includes a number of assemblies (or subassemblies) necessary for implementing the continuous-motion inserting process. Accordingly, inserting apparatus 10 preferably includes at least an insert conveyor assembly, generally designated 30, and an envelope conveyor assembly, generally designated 40. Insert conveyor assembly 30 includes at least one rotating component that is controlled by a servo motor 32. Likewise, envelope conveyor assembly 40 includes at least one rotating component controlled by a servo motor 42. Each servo motor 32 and 42 electrically communicates with, and is thus controlled by, motion controller C. As described more fully hereinbelow, during any given machine (or operating) cycle of inserting apparatus 10, and at any given master cycle speed, the speed at which insert conveyor assembly 30 operates is generally greater than the speed at which envelope conveyor assembly 40 operates. Motion controller C receives the output signal from encoder 20 and, based on this measured master cycle speed, determines the proper operating speeds for insert conveyor assembly 30 and envelope conveyor assembly 40, respectively, as well as start and stop times (if needed during the machine cycle) in order to maintain synchronization. It will be understood that other variable-speed assemblies could be provided as part of, or in combination with, inserting apparatus 10 and likewise be controlled by motion controller C. A user interface UI of a conventional form, such as a keyboard, can also be provided to enable the programming of motion controller C, the input of commands such as START, STOP and JOG, as well as the input of data such as solenoid timing characteristics and desired device activation positions (as described hereinbelow).

Inserting apparatus 10 also includes one or more actuator-operated, peripheral devices or components. Each actuated component is characterized by the fact that the component generally moves between an ON and an OFF state, or equivalently an operational and non-operational state, and further by the fact that a solenoid, pneumatic cylinder, hydraulic cylinder or other actuator is employed to cycle or reciprocate the actuated component between its ON and OFF states. Each actuator, which hereinafter will be referred to by the term "solenoid" in a non-limiting manner, has a fixed activation time as well as a fixed deactivation time. That is, once a control signal is sent to "fire" or energize the solenoid, the duration of time needed for the solenoid to be fully active (such as the time period required for a plunger arm to be extended fully outwardly in order to switch the actuated component into its ON state) is generally and inherently constant. In the same manner, once a control signal is sent to de-energize the solenoid (or in other equivalent cases, once the ON control signal is removed), the time needed for the solenoid to deactivate is also fixed.

In the present embodiment, three solenoid-actuated peripheral devices are illustrated: an envelope opening device, generally designated O; an envelope registration device, generally designated R; and a stuffed envelope take-away device, generally designated TA. Each solenoid-actuated device O, R and TA electrically communicates with, and is thus controlled by, motion controller C. In accordance with the present invention, while the activation/deactivation times of the respective solenoids associated with each device O, R and TA are fixed, their respective firing times and thus their respective fully activated times can vary in response to the master cycle speed read and interpreted by motion controller C.

Figure 2:
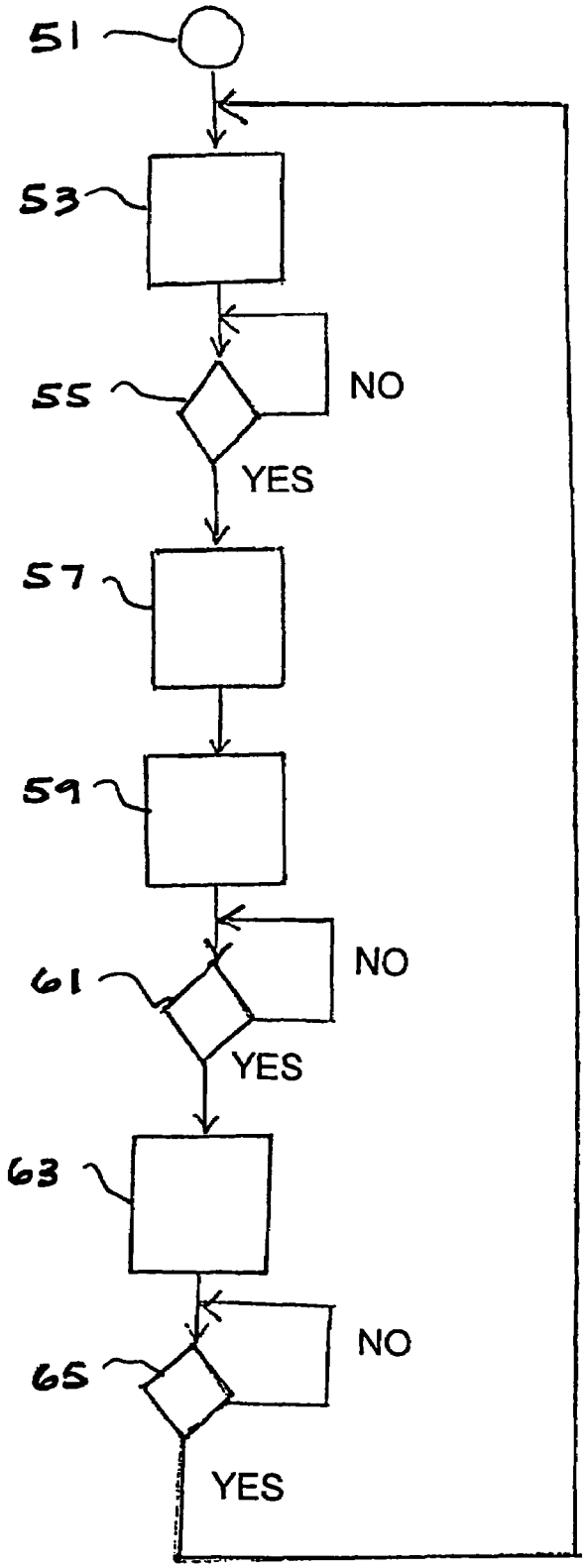
FIG. 2 is a flow diagram illustrating a control process performed during operation of the inserting apparatus shown in FIG. 1.

Referring now to FIG. 2, the basic process by which motion controller C controls the operation of actuated devices O, R and TA, as executed by either firmware or software associated with motion controller C, is illustrated. It will be understood that prior to initialization of the process, the timing characteristics of each solenoid involved will have been determined either through vendor information or testing. The basic process, which occurs once every machine cycle, can be represented by the following algorithm:

BEGIN LOOP

CALCULATE Position To Activate=Desired Activation Position−(Time To Activate×Current Speed Of Master)

WAIT for Current Position>or=Position to Activate
ACTIVATE device

CALCULATE Position to Deactivate=Desired Deactivation Position−(Time To Deactivate×Current Speed of Master)

WAIT for Current Position>or=Position To Deactivate
DEACTIVATE Device
WAIT for End Of Cycle

END LOOP

The various values used in the above algorithm are defined as follows:

Position To Activate=the actual cyclical position at which activation (i.e., firing of the solenoid) will begin to occur;

Desired Activation Position=the cyclical position at which activation should be completed (i.e., when the solenoid is fully active);

Time To Activate=the real time taken for the device to become active (i.e., the generally constant time lag inherent in the device for activation);

Current Speed Of Master=the speed of the master cycle at the time measured;

Current Position=the current position of the master cycle;

Position to Deactivate=the actual cyclical position at which deactivation (e.g., the start of a retraction movement) will begin to occur;

Desired Deactivation Position=the cyclical position at which deactivation should be completed (e.g., full retraction);

Time To Deactivate=the real time taken for the device to become deactivated (i.e., the generally constant time lag inherent in the device for deactivation); and End Of Cycle=a flag or counter denoting that one cycle has passed.

It will be noted that the values for the Desired Activation Position and the Desired Deactivation Position are predetermined by the operator or the programmer of inserting apparatus 10. These values, like those of the corresponding solenoid time lags (Time To Activate and Time To Deactivate), are "absolute" in the sense that they are independent of the Master Speed Of Cycle. For instance, it might be predetermined that a peripheral device O, R or TA must be switched to is operative state at 90 degrees during every machine cycle, in order for its operation to be properly synchronized with other operations performed by inserting apparatus 10. For a given mail inserting job and/or a given insert and envelope size, this criterion will not change. However, the rotational position or angle relative to the machine cycle at which the corresponding solenoid must be fired so that peripheral device O, R or TA becomes fully active at 90 degrees will vary with the speed of the machine cycle. Thus, the above-described control process is used to make the necessary adjustments in response to a changed cycle speed.

Referring now to the flow diagram of FIG. 2, the control process performed by motion controller C for each actuated device O, R and TA is further described. At step 51, inserter apparatus 10 (or master drive assembly 15 thereof) begins to rotate, and motion controller C receives an output signal from encoder 20 (see FIG. 1). Once inserting apparatus 10 is powered up at starting step 51, at step 53, using the cycle speed (Current Speed Of Master) read by encoder 20 and the time lag information (Time To Activate) indexed to the particular actuated device O, R or TA to be controlled, motion controller C determines the proper point in time during the current machine cycle at which to fire the corresponding solenoid (Position To Activate). At step 55, motion controller C waits for the current rotational position of the master cycle (Current Position) to at least reach the calculated Position to Activate the solenoid. Motion controller C can do this by counting output pulses from encoder 20 that identify the current rotational position of inserter apparatus 10 along its machine cycle. At step 57, as soon as motion controller C determines that the Current Position equals or exceeds the calculated Position To Activate, motion controller C sends a control signal or takes some other appropriate step to cause the solenoid to fire. In this manner, solenoid will activate its associated device O, R or TA at the proper rotational position of the machine cycle, in synchronization with the respective operations of insert conveyor assembly 30 and envelope conveyor assembly 40 (see FIG. 1).

Continuing to step 59, motion controller C then uses the cycle speed (Current Speed Of Master) previously received from encoder 20, as well as the time lag information (Time To Deactivate) indexed to actuated device O, R or TA, to determine the proper point in time during the current machine cycle at which to deactivate the solenoid (Position To Deactivate). At step 61, motion controller C waits for the current rotational position of the master cycle (Current Position) to at least reach the calculated Position to Deactivate the solenoid. At step 63, as soon as motion controller C determines that the Current Position equals or exceeds the calculated Position To Deactivate, motion controller C sends a control signal or takes some other appropriate step to cause the solenoid to become de-energized. In this manner, solenoid will de-activate its associated device O, R or TA at the proper rotational position of the machine cycle, in synchronization with the respective operations of insert conveyor assembly 30 and envelope conveyor assembly 40. Moreover, actuated device O, R or TA will remain deactivated until the proper time for re-activation, so as not to interfere with the respective operations of insert conveyor assembly 30 and envelope conveyor assembly 40. Finally, at step 65, motion controller C waits for the occurrence of the End Of Cycle to be flagged, after which it begins the next control sequence as described above.

It will be noted that, because motion controller C executes its control process once every machine cycle, the frequency by which motion controller C executes the control process, for any given actuated device, varies directly with the speed of the machine cycle. Hence, motion controller C carries out a true real-time, "on-the-fly" control process that does not lag behind the machine cycle. At the same time, however, one complete machine cycle of inserting apparatus 10 can virtually always be expected to last longer than 100 milliseconds. Accordingly, any CPU or other electronic processor associated with motion controller C, having moderate processing speed, should not be detrimentally affected by execution of this control process. It will be further noted that motion controller C makes its adjustments to the respective activation and deactivation cyclic positions of all peripheral devices O, R and TA involved, without the need for manual adjustments by an operator of inserting apparatus 10.

Referring now to FIGS. 3-8, exemplary embodiments are illustrated for continuous motion inserting apparatus 10. In accordance with the present invention, inserting apparatus 10 is advantageously controlled by motion controller C, which is programmed to implement the control process described hereinabove. As described previously, inserting apparatus 10 comprises insert conveyor assembly 30 and envelope conveyor assembly 40. Both insert conveyor assembly 30 and envelope conveyor assembly 40 are servo motor-controlled mechanisms and operate to continuously feed their respective products, i.e., inserts I and envelopes E in a feed direction F without stopping for any substantial amount of time. During this feeding process, as will be described below, insert conveyor assembly 30 and envelope conveyor assembly 40 cooperate to place an insert I within a corresponding envelope E.

Figure 3:
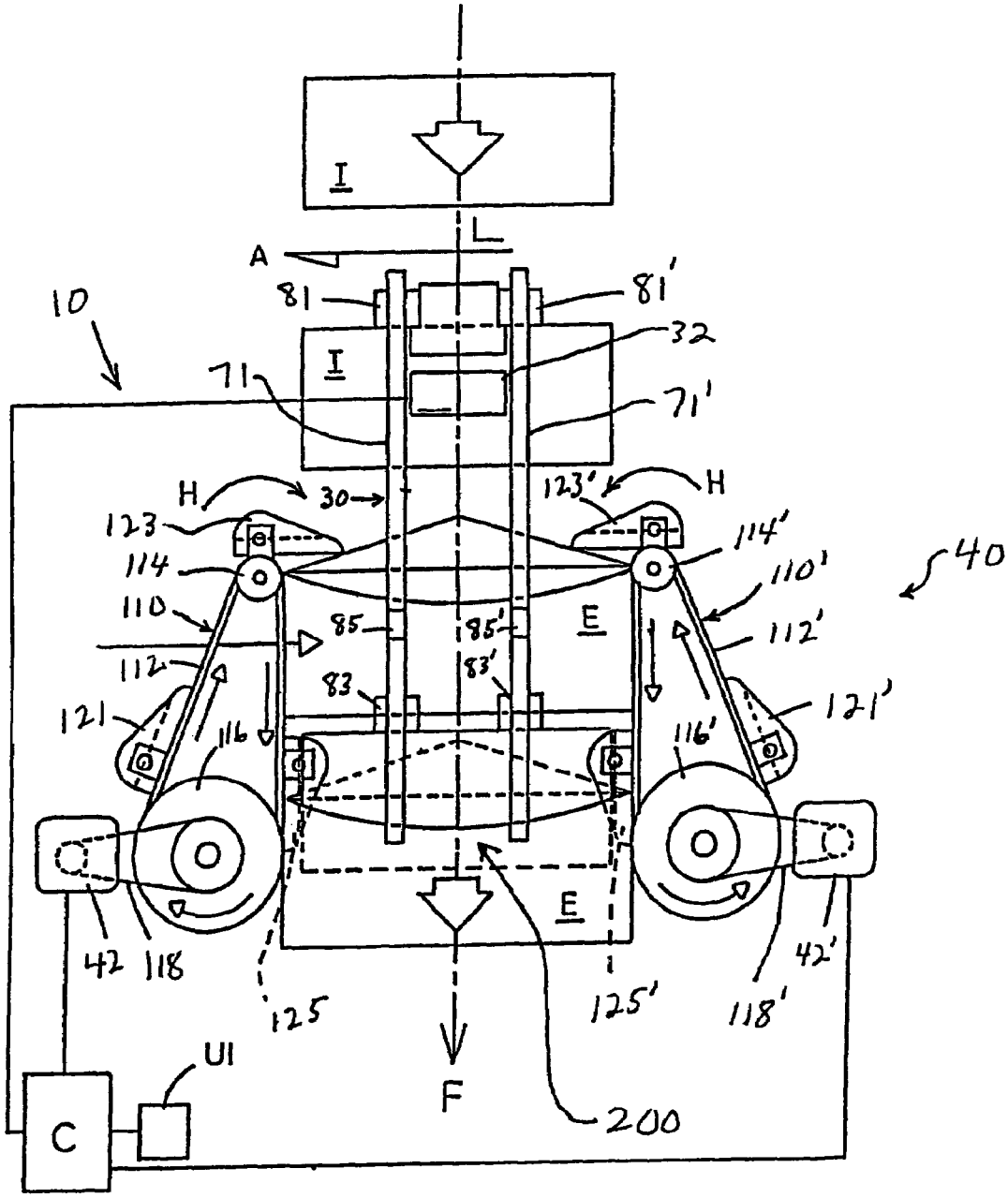
FIG. 3 is a top plan view of one embodiment of the inserting apparatus according to the present invention.
Figure 4:
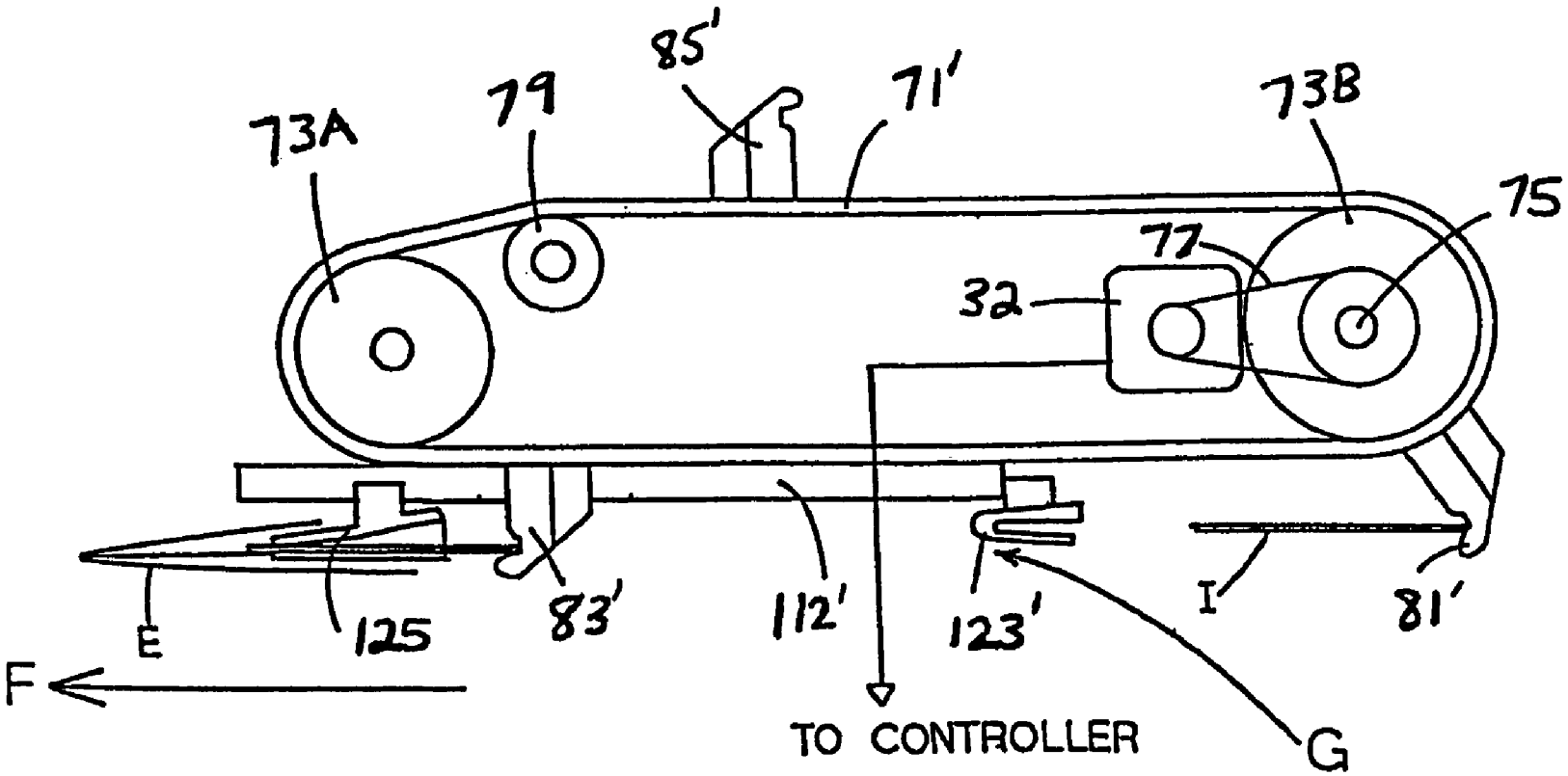
FIG. 4 is a side elevation view of a portion of the inserting apparatus shown in FIG. 3.

As shown in FIGS. 3 and 4, insert feed conveyor assembly 30 includes side-by-side chain (or, alternatively, belt) conveyors in which each chain 71 and 71' is wrapped around one or more pairs of rotatable sprockets 73A and 73B, respectively. To drive each chain 71 and 71', it is preferred to fixedly mount an adjacent pair of sprockets 73B on common drive shaft 75 and then connect drive shaft 75 to servo motor 32 by a mechanical movement 77, such as a conventional belt and pulley combination. It is also possible to mount each sprocket 73A on its own axle and then connect each axle to its own servo motor 32. In either form, however, servo motor(s) 32 electrically communicates with, and thus is controlled by, motion controller C as described hereinabove. In addition, tension sprockets 79 take up any slack in chains 71 and 71' and therefore control the tension in chains 71 and 71'. Finally, each chain 71 and 71' has a plurality of insert transport elements such as pusher fingers 81, 81', 83, 83', 85 and 85', attached thereto. These pusher fingers 81, 81', 83, 83', 85 and 85' operate to push insert I downstream in feed direction F and at a continuous and constant speed. As shown in the alternative embodiment of FIGS. 5A-5C, additional pusher fingers, such as pusher fingers 82, 82', 84 and 84', can be provided to handle a greater number of inserts I along feed direction F. As also best shown in FIG. 5A, additional pairs of sprockets 73A and 73B and tension sprockets 79 can be provided if desired.

Figure 5A:
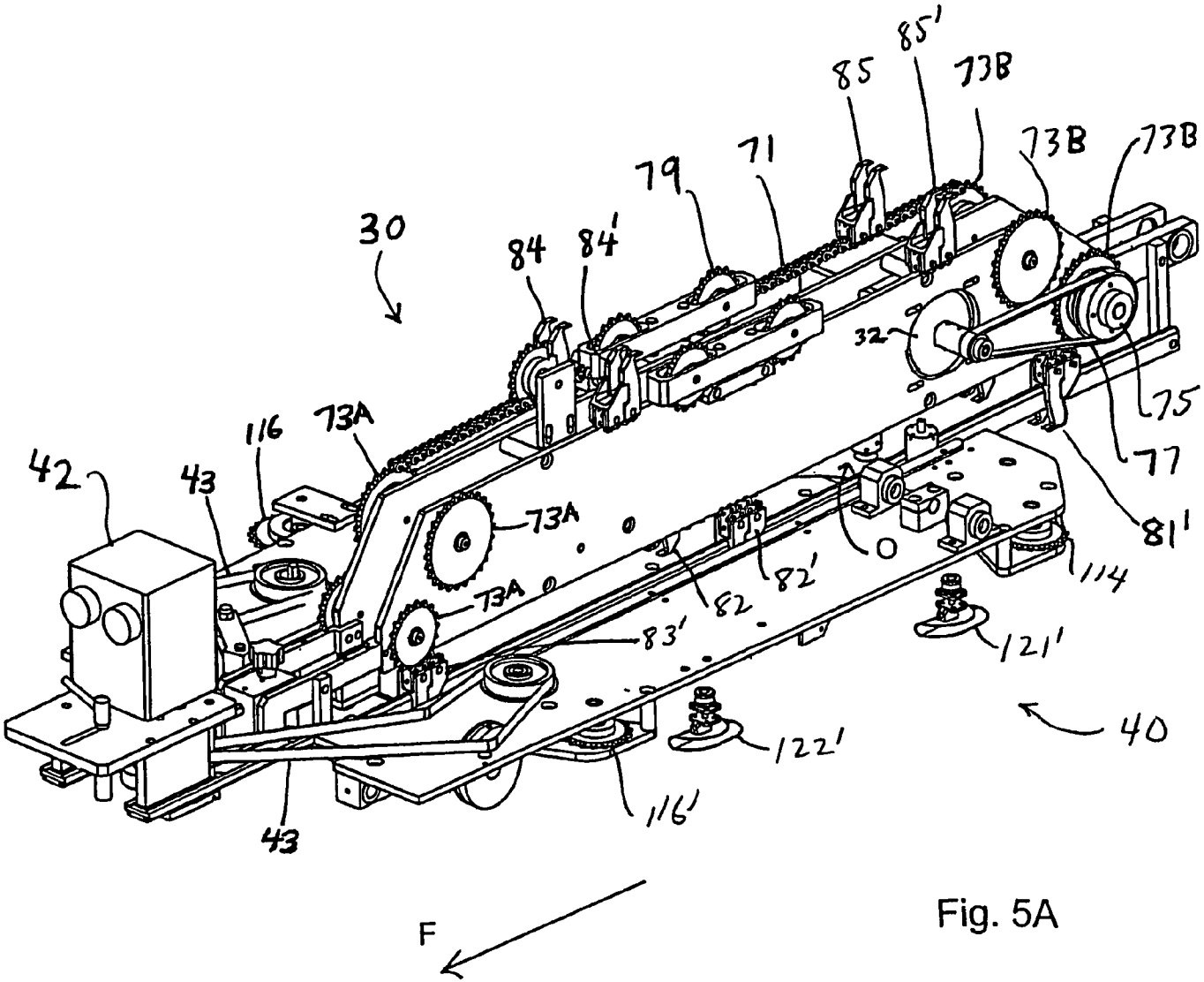
FIGS. 5A and 5B are perspective views of another embodiment of the inserting apparatus according to the present invention.
Figure 5B:
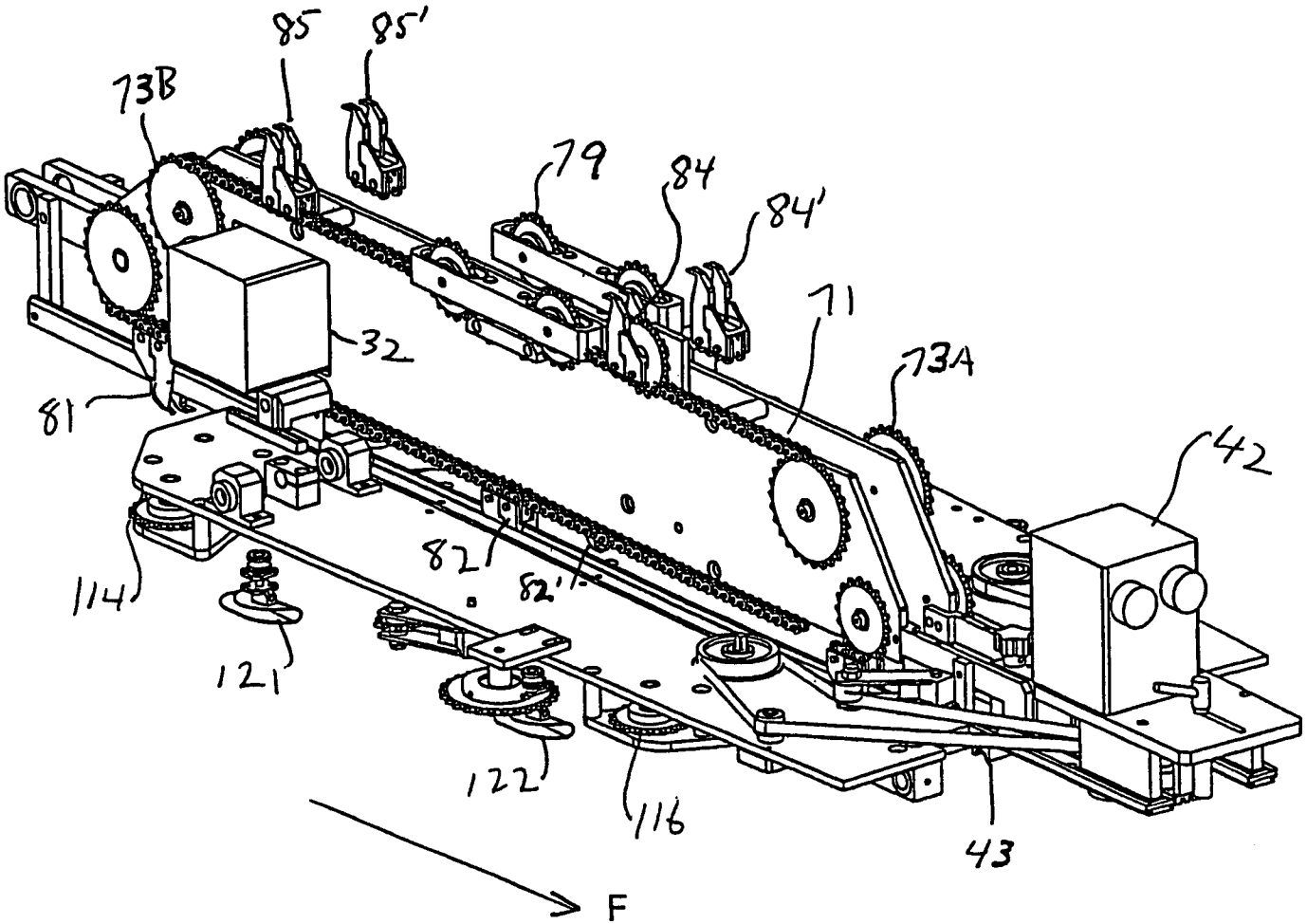
Figure 5C:
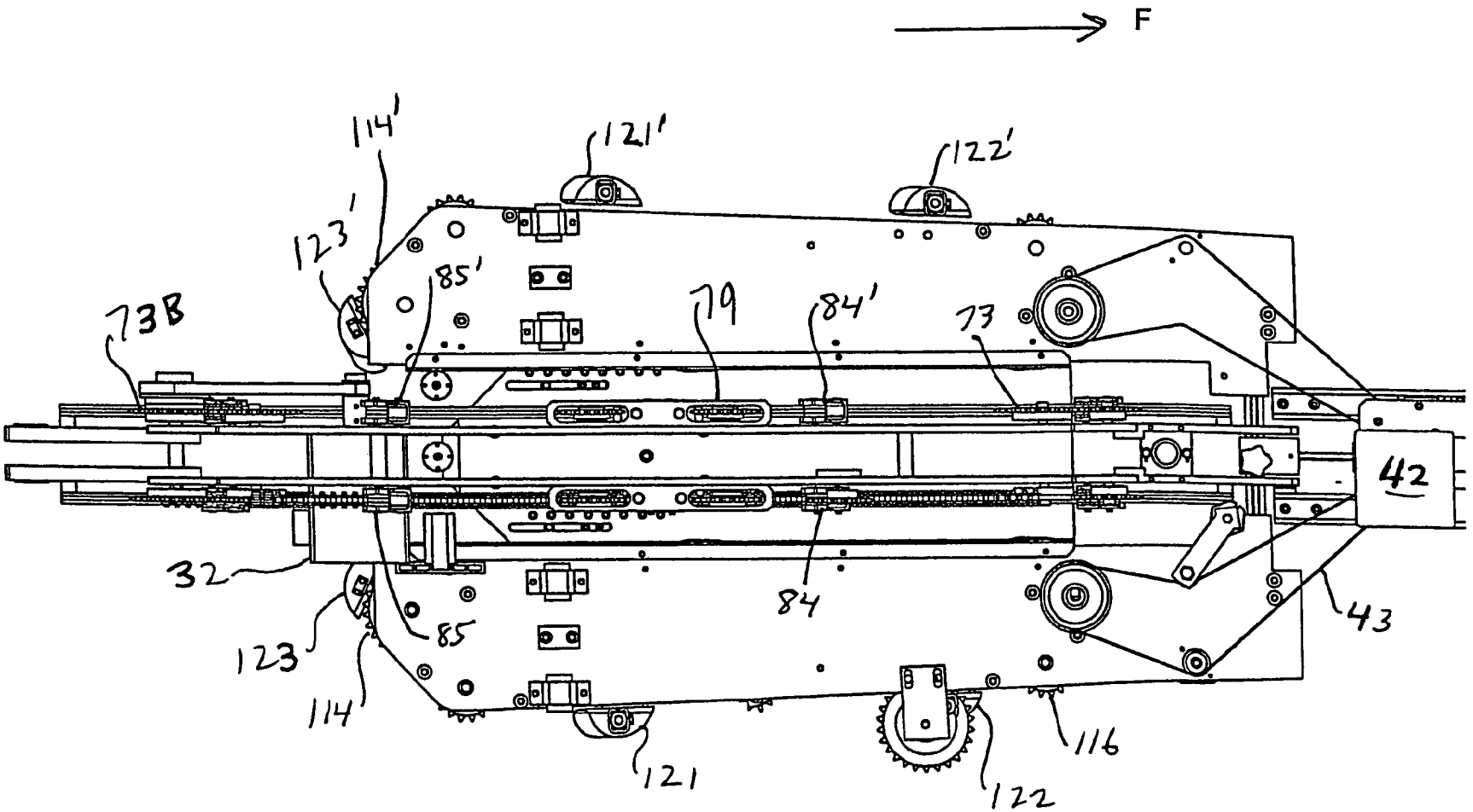
FIG. 5C is a top plan view of the inserting apparatus shown in FIGS. 5A and 5B.

As best shown in FIG. 3, envelope conveyor assembly 40 preferably includes a pair of envelope transport conveyor subassemblies, generally designated 110 and 110', which are essentially mirror images of each other and cooperate to transport envelopes E downstream in feed direction F at a constant speed, with only momentary stopping during a registration step. Each envelope transport conveyor subassembly 110 and 110' is also preferably a chain (or belt) mechanism, like those that make up insert conveyor assembly 30. Chains 112 and 112' are wrapped around rotatable sprockets 114, 116 and 114', 116', respectively. Sprockets 116 and 116' of each of envelope transport conveyor subassemblies 110 and 110' are respectively connected to servo motors 42 and 42' through a mechanical movement 118 and 118', such as a conventional belt and pulley system. It is also possible to commonly drive envelope transport conveyor subassemblies 110 and 110' by a common servo motor 42 and associated drive assembly 43, as shown in FIGS. 5A-5C. In either case, like servo motor 32, servo motors 42 and 42' are electrically connected to, and thus controlled by, motion controller C.

For transporting envelopes E along feed path F, each envelope transport conveyor chain 112 and 112' is provided with a plurality of envelope control elements or opening fingers 121, 121', 123, 123', 125 and 125' that work together in opposing pairs. Additional pairs of opening fingers can be provided in order to handle a greater number of envelopes E along feed path F, such as the pair of opening fingers 122 and 122' shown in FIGS. 5A-5C. Each opening finger 121, 121', 123, 123', 125 and 125' may be similarly constructed from suitably formed sheet metal or plastic in an elongated channel-shaped cross-section having its forward end shaped and constructed, i.e., tapered, to facilitate entry into the mouth of an envelope E. Opening fingers 121, 121', 123, 123', 125 and 125' continuously travel along the paths defined by chains 112 and 112' in the direction of arrows H and at a constant speed.

In the embodiment shown in FIG. 5C, it can be seen that feed path F is longer between the general areas where an envelope E is presented, opened, filled with an insert I and taken away, as compared with the embodiment shown in FIG. 3. The longer feed path F in FIG. 5C permits more than one pair of envelopes E and inserts I to be processed at the same time during the operation of inserting apparatus 10. For example, one envelope E can be opened at the same time as an insert I is being inserted into another envelope E or as a filled envelope E is being taken away, while another intermediate pair of envelopes E and inserts I are being transported from the presentation or registration point to the filling point. Hence, in one specific example of the embodiment shown in FIG. 5A, just over two complete machine cycles will have transpired from the time that an envelope E is fed to the transport plane for registration to the time that the same envelope E is filled with an insert I. In other embodiments of inserting apparatus 10 having shorter feed paths F, only one envelope E is transported over the transport plane during any given machine cycle.

Figure 6:
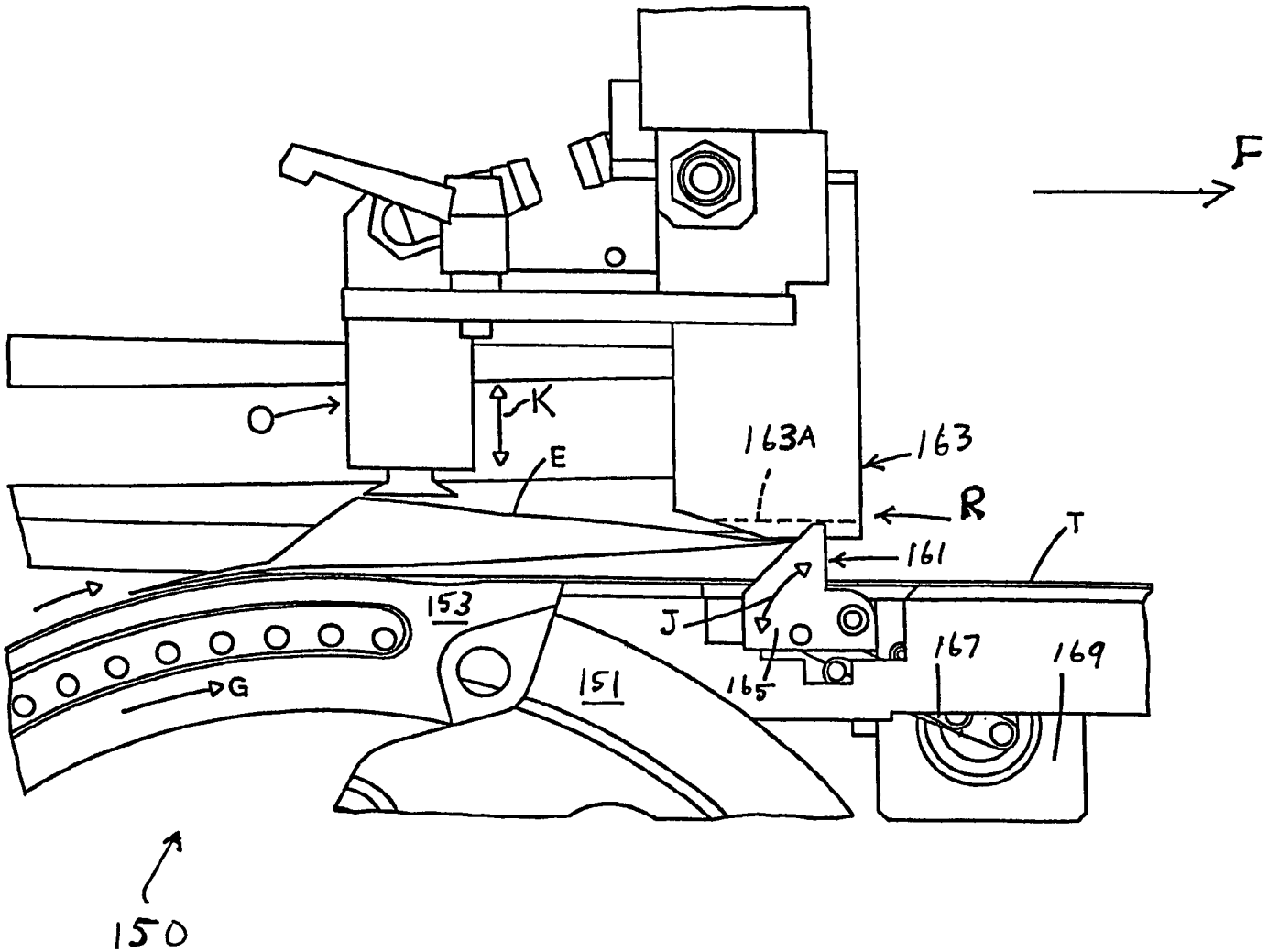
FIG. 6 is a side elevation view of another portion of the inserting apparatus shown in FIG. 3.

FIG. 6 is an elevation view depicting the presentation, registration and opening of an envelope E. Envelopes E are fed to envelope transport conveyor subassemblies 110 and 110' from an envelope feed assembly, generally designated 150, a portion of which is illustrated in FIG. 6, in the feed direction represented by arrow G. Envelope feed assembly 150 can include, for example, a conventional rotating, vacuum-operated envelope drum 151 having an envelope gripping member 153 thereon and positioned below a table surface T. Table surface T has a slot therein so that envelopes E can be fed by envelope drum 110 from a position below table surface T to a position above table surface T so that each envelope E can be registered, opened, and stuffed.

To register envelope E in the registration area, registration mechanism generally designated R is used. Registration mechanism R, preferably in the form of a front edge registration system, includes retractable lower portion, generally designated 161, and stationary upper portion, generally designated 163. Stationary upper portion 163 comprises a plurality of spaced apart vertical plates 163A. Retractable lower portion 161 comprises a moveable front stop 165 that is activated by an actuator for rotation along an arcuate direction indicated by arrow J. In the present embodiment, front stop 165 is attached through a suitable mechanical linkage 167 to a motor 169 that serves as the actuator. Mechanical linkage 167 converts the rotary motion of motor 169 into the reciprocating motion of front stop 165. However, any type of motor and any type of linkage may be used so long as stop 165 can be moved above or below table surface T. As in the case of other actuator-type components described herein, this motor 169 electrically communicates with, and is thus controlled by, motion controller C.

When in its raised position, stop 165 interacts with vertical plates 163A to form a gate that prevents envelopes E from passing through. This gate also forms a front registration element. Therefore, as envelope E is fed into the registration by envelope gripping member 153 of envelope drum 151, its leading edge will be brought into contact with registration elements 161 and 163, thereby registering and squaring envelope E. Envelope E is momentarily stopped at this time.

Figure 7A:
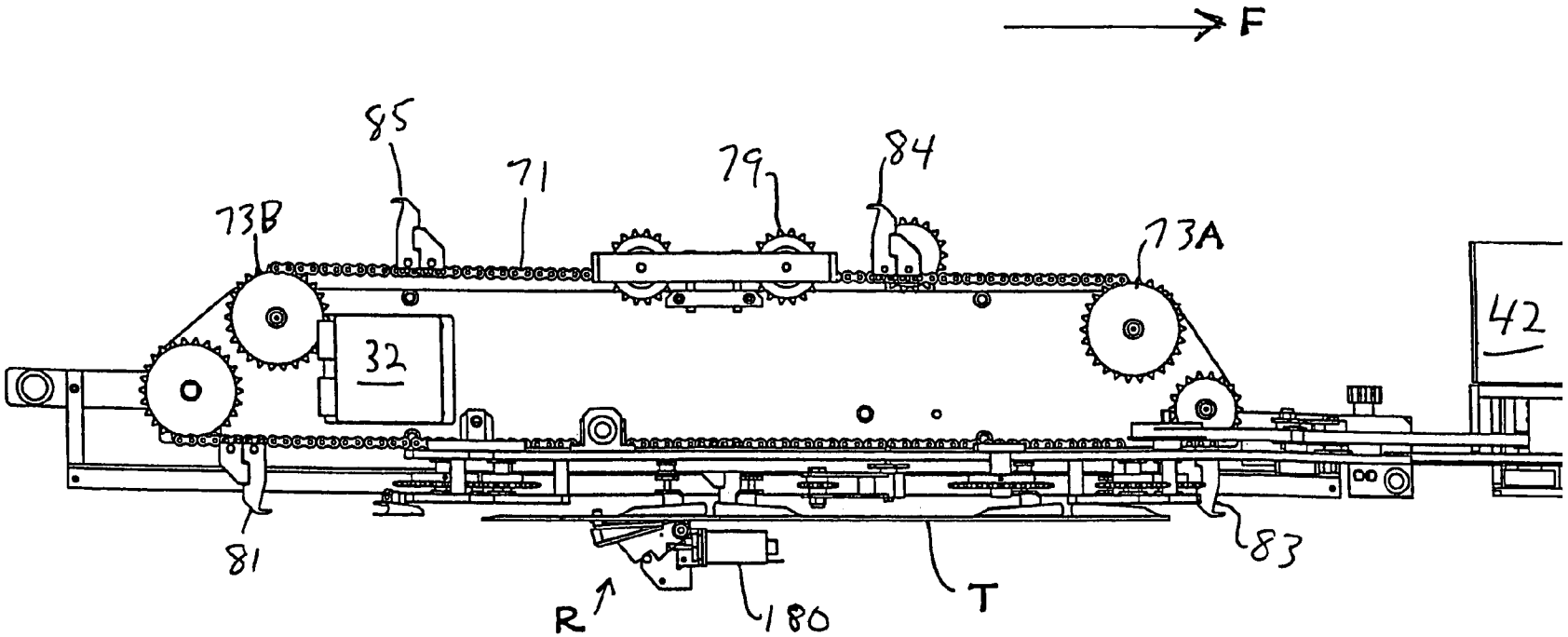
FIG. 7A is a side elevation view of a portion of the inserting apparatus shown in FIGS. 5A and 5B.
Figure 7B:
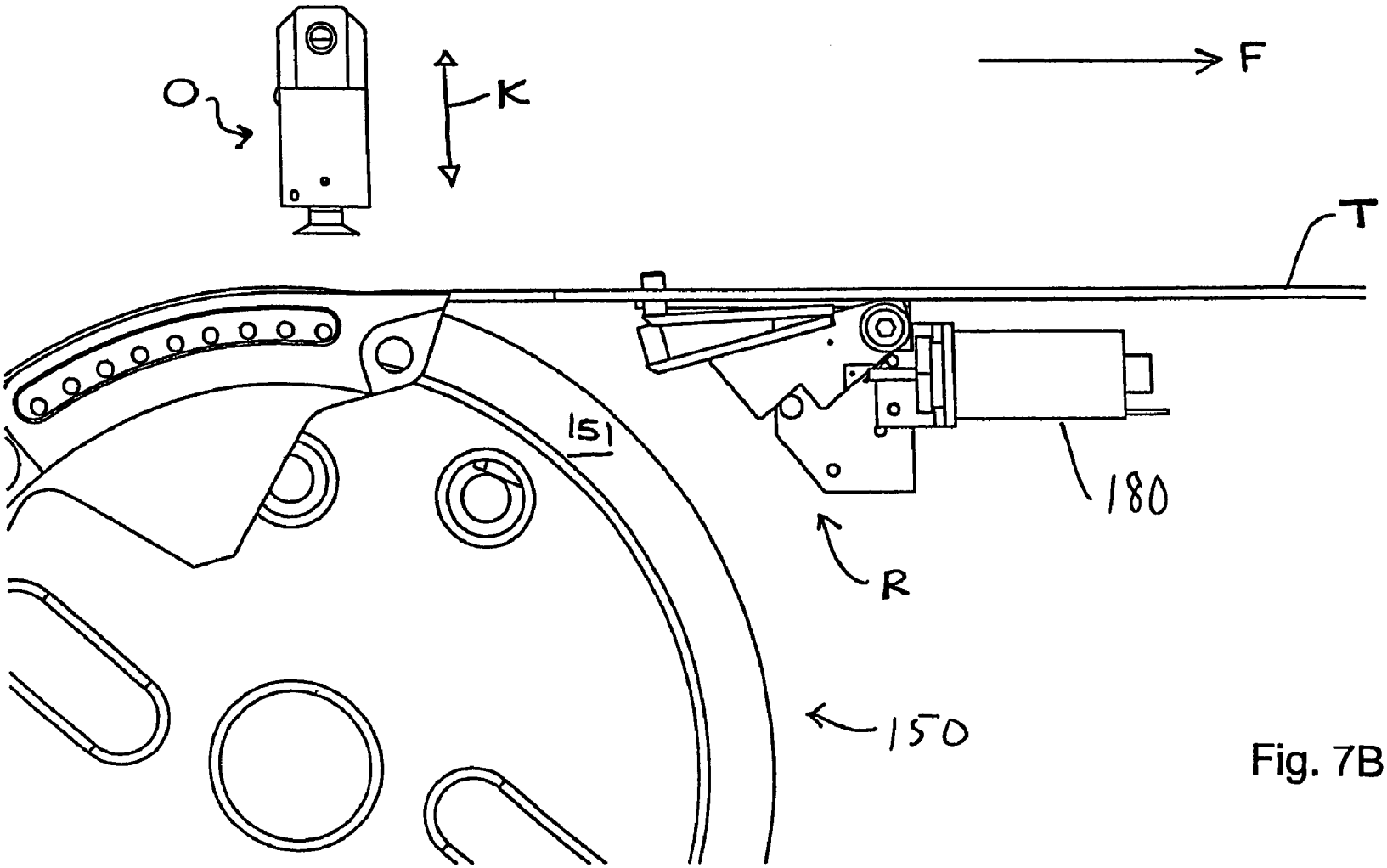
FIG. 7B is a side elevation view of another portion of the inserting apparatus shown in FIGS. 5A and 5B.

Referring to FIGS. 7A and 7B, an additional embodiment of inserting apparatus 10 is shown to include an alternative form of envelope registration mechanism R. In this embodiment, envelope registration mechanism R is activated by a solenoid-type actuator 180. Again, actuator 180 electrically communicates with, and is thus controlled by, motion controller C.

Because envelope E is momentarily stopped in inserting apparatus 10 according to the invention, inserting apparatus 10 might not be characterized as being a true continuous inserting apparatus. However, this stop time (dwell) is both short in an absolute sense as well as in relation to the overall apparatus cycling time. For example, in one specific embodiment of inserting apparatus 10, inserting apparatus 10 operates between 4,000 envelopes per hour and 25,000 envelopes per hour. In this example, the dwell time corresponding to the lower limit speed of 4,000 envelopes per hour is 106 milliseconds, and the dwell time corresponding to the higher limit speed of 25,000 envelopes per hour is 40 milliseconds. Generally, the dwell time will be less than 1 second. Furthermore, in inserting apparatus 10 according to the present invention, both envelope E and insert I are in motion during the entire inserting step. In a conventional incremental inserter, not only is the stop time (dwell) much longer both in absolute and relative terms, but the envelope is stationary during the entire inserting step. Accordingly, despite the small stop (dwell) time in inserting apparatus 10 according to the invention, inserting apparatus 10 still better approximates the operation of a true continuous motion inserting apparatus and therefore can be labeled as such.

Referring back to FIG. 6, after envelope E is stopped, squared and registered, envelope E is opened by envelope opening mechanism, generally designated O. Typically, envelope opening mechanism O includes some type of vertically movable vacuum element that is able to pull apart the walls of envelope E. In addition, envelope opening mechanism O includes a solenoid or other actuator to cause envelope opening mechanism O to reciprocate along the direction indicated by arrow K. Envelope opening mechanism O electrically communicates with, and is thus controlled by, motion controller C. After envelope E is opened, stop 165 is lowered to its position below table surface T and envelope transport conveyor subassemblies 110 and 110' take over the feeding of envelope E.

Accordingly, referring back to FIG. 3, a pair of opposing opening fingers 123 and 123' will swing around sprockets 114 and 114', and begin to enter the gap of the mouth of opened envelope E along the opposite edges of envelope E. As opening fingers 123 and 123' continue to move in feed direction F, they will continue entering envelope E until fully inside. By that point, opening fingers 123 and 123' will have complete control of envelope E, feeding it downstream again as all opening fingers 121, 121', 123, 123', 125 and 125' move downstream. Although envelope E was momentarily stopped from being fed, as described above, this time period is small in absolute terms as well as in relation to the inserter cycle speed that it results in a minimal delay, unlike the substantial delays incurred in prior art non-continuous (incremental) motion inserting apparatuses. Within engaged envelope E, opening fingers 123 and 123' provide, in effect, an insert receiving funnel opening rearward. To facilitate reception of inserts I into the funnel thus provided, opening fingers 121, 121', 123, 123', 125 and 125' are preferably provided on their lower rear portions with flanges which can extend into close proximity of each other over the envelope flap (to hold the flap open).

As each envelope E is thus readied in the filling or stuffing zone, generally indicated at 200, inserts I are thrust by insert conveyor assembly 30 through opening fingers 121, 121', 123, 123', 125 and 125' and into envelopes E. The speed of insert conveyor assembly 30 is set to a speed faster than that by which envelopes E are fed downstream in direction F by envelope transport conveyor assembly 40. Thus, inserts I will completely be inserted into envelopes E. It thus can be seen that each envelope E is moved in a downstream direction as envelope E is being filled, i.e., during the insertion step. Other than during the short moment taken by the registration step, each envelope E is continuously moving downstream and is not stationary. After envelope E has been filled, envelope E is transported away from inserting apparatus 10 to any further downstream stations that might be provided.

Figure 8:
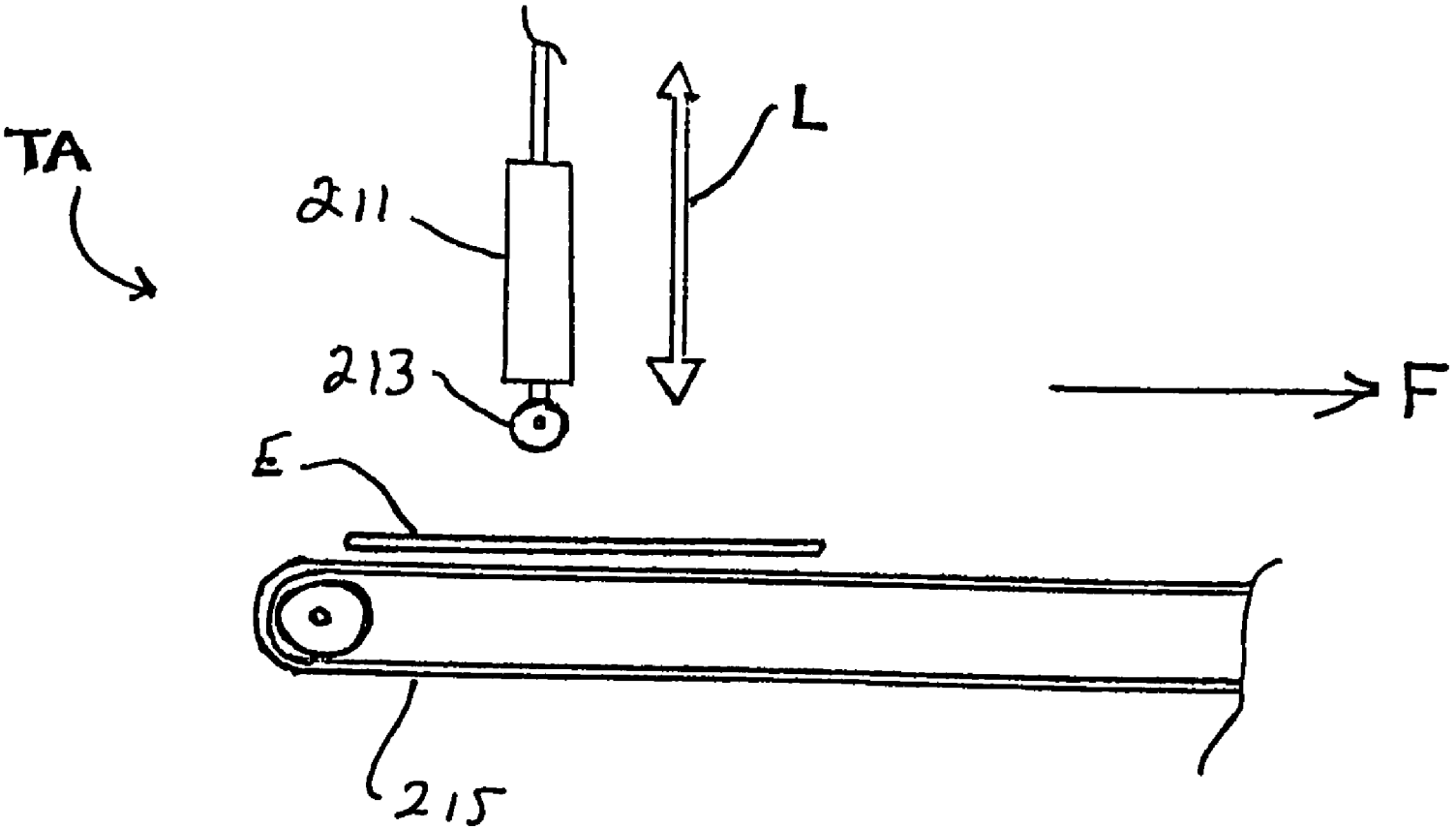
FIG. 8 is a side elevation view of a mail piece take-away device provided in accordance with the present invention.

Referring to FIG. 8, an exemplary mail piece take-away device, generally designated TA, is illustrated. Take-away device TA is typically disposed above or immediately downstream of filling zone 200 (see FIG. 3). Take-away device TA generally includes a reciprocating element 211 and a roller 213. Reciprocating element 211 has or is attached to a solenoid or equivalent actuator, to enable reciprocating element 211 to travel upwardly and downwardly along the direction indicated by arrow L. Take-away device TA electrically communicates with, and is thus controlled by, motion controller C. Accordingly, motion controller C causes the actuator of take-away device TA to urge reciprocating element 211 downwardly until roller 213 contacts stuffed envelope E. At this point, envelope E bears down on a take-away conveyor assembly 215, which could be a moving belt as illustrated or could be a driven roller assembly, and consequently is transported along feed direction F to downstream locations.

It is therefore seen from the above description that the present invention provides an apparatus, and a method for controlling the same, in which peripheral devices exhibiting generally constant time lags during activation are precisely and adaptively timed, during each master cycle, in relation to the various rotational assemblies constituting the apparatus, in response to an increase or decrease in the operational speed of the apparatus. As a result, synchronization can be effectively maintained throughout a wide range of operating speeds, thereby enhancing the functional flexibility and accuracy of the apparatus.

It will be understood that various details of the invention may be changed without departing from the scope of the invention. Furthermore, the foregoing description is for the purpose of illustration only, and not for the purpose of limitation—the invention being defined by the claims.

What is claimed is:

1. A method for controlling an inserting apparatus over a range of master cycle speeds, the method comprising the steps of:

(a) monitoring a master cycle speed at which an inserting apparatus operates over a plurality of master cycles;

(b) determining when a new master cycle has begun;

(c) at least once during every master cycle of operation of the inserting apparatus, performing a first calculation to determine a first cyclical position of the new master cycle at which an actuated device should begin to be activated, wherein the calculation is based on the master cycle speed measured for the new master cycle, a predetermined time duration required for the actuated device to become fully active, and a predetermined cyclical position of the new master cycle at which the actuated device should be fully active; and (d) at least once during every master cycle of operation of the inserting apparatus, causing the actuated device to begin to be activated when the new master cycle reaches or exceeds the calculated first cyclical position.

2. The method according to claim 1 comprising the steps of:

(a) at least once during every master cycle of operation of the inserting apparatus, performing a second calculation to determine a second cyclical position of the new master cycle at which an actuated device should begin to be deactivated, wherein the calculation is based on the master cycle speed measured for the new master cycle, a predetermined time duration required for the actuated device to become inactive, and a predetermined cyclical position of the new master cycle at which the actuated device should be fully inactive; and (b) at least once during every master cycle of operation of the inserting apparatus, causing the actuated device to become inactive when the new master cycle reaches or exceeds the calculated second cyclical position.

3. The method according to claim 1 wherein the step of causing the actuated device to begin to be activated includes energizing an envelope opening device.

4. The method according to claim 1 wherein the step of causing the actuated device to begin to be activated includes energizing an envelope registration device.

5. The method according to claim 1 wherein the step of causing the actuated device to begin to be activated includes energizing a mail piece take-away device.

6. The method according to claim 1 further comprising the steps of:

(e) feeding an insert along a feed path at an insert feed rate in timed relation with the activation of the actuated device;

(f) feeding an envelope along the feed path at an envelope feed rate in timed relation with the activation of the actuated device, wherein the insert feed rate is greater than the envelope feed rate; and (g) causing the insert to be inserted into the envelope in timed relation with the activation of the actuated device, wherein activation of the actuated device assists in an inserting process performed by the inserting apparatus.

7. The method according to claim 6 wherein the step of causing the actuated device to begin to be activated includes energizing an envelope opening device.

8. The method according to claim 6 wherein the step of causing the actuated device to begin to be activated includes energizing an envelope registration device.

9. The method according to claim 6 wherein the step of causing the actuated device to begin to be activated includes energizing a mail piece take-away device.

10. A method for controlling an inserting apparatus over a range of master cycle speeds, the method comprising the steps of:

(a) monitoring a master cycle speed at which an inserting apparatus operates over a plurality of master cycles;

(b) determining when a new master cycle has begun;

(c) during every master cycle of operation of the inserting apparatus, performing a first calculation to determine a first cyclical position of the new master cycle at which an actuated device should begin to be activated; and (d) at least once during every master cycle of operation, causing the actuated device to begin to be activated when the new master cycle reaches or exceeds the calculated first cyclical position.

11. The method according to claim 10, wherein the calculation is based on the master cycle speed measured for the new master cycle, a predetermined time duration required for the actuated device to become fully active, and a predetermined cyclical position of the new master cycle at which the actuated device should be fully active.

12. The method according to claim 10 comprising the steps of:

(a) at least once during every master cycle of operation of the inserting apparatus, performing a second calculation to determine a second cyclical position of the new master cycle at which an actuated device should begin to be deactivated; and (b) at least once during every master cycle of operation of the inserting apparatus, causing the actuated device to become inactive when the new master cycle reaches or exceeds the calculated second cyclical position.

13. The method according to claim 12, wherein the second calculation is based on the master cycle speed measured for the new master cycle, a predetermined time duration required for the actuated device to become inactive, and a predetermined cyclical position of the new master cycle at which the actuated device should be fully inactive.

14. The method according to claim 10 wherein the step of causing the actuated device to begin to be activated includes energizing an envelope opening device.

15. The method according to claim 10 wherein the step of causing the actuated device to begin to be activated includes energizing an envelope registration device.

16. The method according to claim 10 wherein the step of causing the actuated device to begin to be activated includes energizing a mail piece take-away device.

* * * * *